United States Patent [19]

Takematsu

[11] Patent Number: 4,469,989

[45] Date of Patent: Sep. 4, 1984

[54] ELECTRIC FLASH APPARATUS

[75] Inventor: Yoshiyuki Takematsu, Tokyo, Japan

[73] Assignee: Fuji Koeki Corporation, Tokyo, Japan; a part interest

[21] Appl. No.: 353,354

[22] Filed: Mar. 1, 1982

[51] Int. Cl.[3] ..... H05B 41/34

[52] U.S. Cl. ..... 315/241 P; 315/151; 315/159; 315/241 S

[58] Field of Search ..... 315/151, 159, 241 P, 315/241 S; 354/145, 33; 352/200

[56] References Cited

U.S. PATENT DOCUMENTS 3,998,534 12/1976 Schulze et al. ..... 315/241 P X 4,210,849 7/1980 Naya et al. ..... 354/33 X

*Primary Examiner*—Eugene R. LaRoche

*Attorney, Agent, or Firm*—Fleit, Jacobson, Cohn & Price

[57] ABSTRACT

The present invention provides an electric flash apparatus which comprises power supplying means, trigger signal generating means, flashlight generating means, trigger signal controlling means for controlling the trigger signal generating means and flashlight quantity control means for adjusting automatically the light quantity of the flashlight. The electric flash apparatus of the invention can operate as a mono-flashing device and as a multi-flashing device, and the electric flash apparatus of the invention further can control quantity of the flashlight of a flash tube in both of the mono-flashing operation and the multi-flashing operation, in spite of the photographing distance.

16 Claims, 7 Drawing Figures

ELECTRIC FLASH APPARATUS

FIELD OF THE INVENTION

The present invention relates to a flash apparatus, and more particularly to an electric flash apparatus which can be used for a multi-flashing device and a mono-flashing device.

BACKGROUND OF THE INVENTION

In recent years, a flash device has been widely employed to an optical apparatus such as, for example, a camera. Particularly when the flash device is employed in the photographing, the light is the important component. In an automatic light adjusting device which is employed in the photographing, the flashlight is ceased when the reflecting light from an object to be photographed attains to a predetermined value.

The reflected light from the object to be photographed is, however, few in case that color of the object is black or in case that distance from the object to be photographed to the flash device is long, and an automatic light adjusting device was inactivated, and therefore a photographer could not judge easily how to the distance between the object and the flash device or to adjust the diaphragm. To contrary, the object to be photographed is white, the quantity of the reflected light becomes much, and the quantity of the reflecting light becomes much when the distance from the object to the flash device is very short. Accordingly, the automatic light adjusting device does not activate correctly. It is also impossible for the photographer to alternate the distance or to adjust the diaphragm.

A flash device which can produce multiple flashlight during a predetermined time interval is so called a multi-flashing device. Thus multi-flashing device can produce the multiple flashlight momentarily and periodically. By using the multi-flashing device, it is possible to photograph a rotating substance or a moving substance at the stationary state by means of the flashlight which is repeated momentarily and periodically. In this kind of prior art multi-flashing device, the quantity of the flashlight in short distance photographing was same value with that of the flashlight in long distance photographing in spite that the few quantity of the flashlight is adequate in short distance photographing, since the multi-flashing device has not been provided with a light quantity control device which can automatically control the quantity of light. It was, accordingly, impossible to increase the flashing times and to make repetition of the flashing of the flash device particularly employing a battery as a power source faster in short distance photographing, and, therefore, it was impossible to obtain the suitable exposure.

SUMMARY OF THE INVENTION

It is, accordingly, an object of the present invention to provide a high performance electric flash apparatus which is able to carry out an automatic light exposure control in multi-flashing, as well as is convenient to use.

It is other object of the present invention to provide an electric flash apparatus which can be employed in both of the mono-flashing device and the multi-flashing device.

It is further object of the present invention to provide an electric flash apparatus which can control the quantities of both of the mono-flashing and the multi-flashing modes, as well as in the short distance photographing and in the long distance photographing.

According to the present invention there is provided an electric flash apparatus comprising, in combination, electric power supplying means including a direct current power source for supplying electric power, voltage converting means for converting a direct current voltage of said power source circuit to a high alternating current voltage and for rectifying the high alternating current voltage to a high direct current voltage, electric charge storing means for storing electric energy from the voltage converting means, a flashlight generating circuit including a flash tube for generating flashlight, trigger signal generating means for generating triggering signal for triggering said flash tube of the flashlight generating means, trigger signal controlling means for controlling said trigger signal generating means such that the flashlight generating means generates a given time flashing at a predetermined time interval, and flashlight quantity control means for adjusting automatically the quantity of the flashlight produced from said flashlight generating means and reflected from an object to be photographed attains to the predetermined value.

BRIEF DESCRIPTION OF THE DRAWING

The other objects and features of the present invention will be best understood by the description of the preferred embodiment when read in conjunction with an electric flash device of the present invention.

DESCRIPTION OF THE PREFERRED EMBODIMENT

Figure 1:
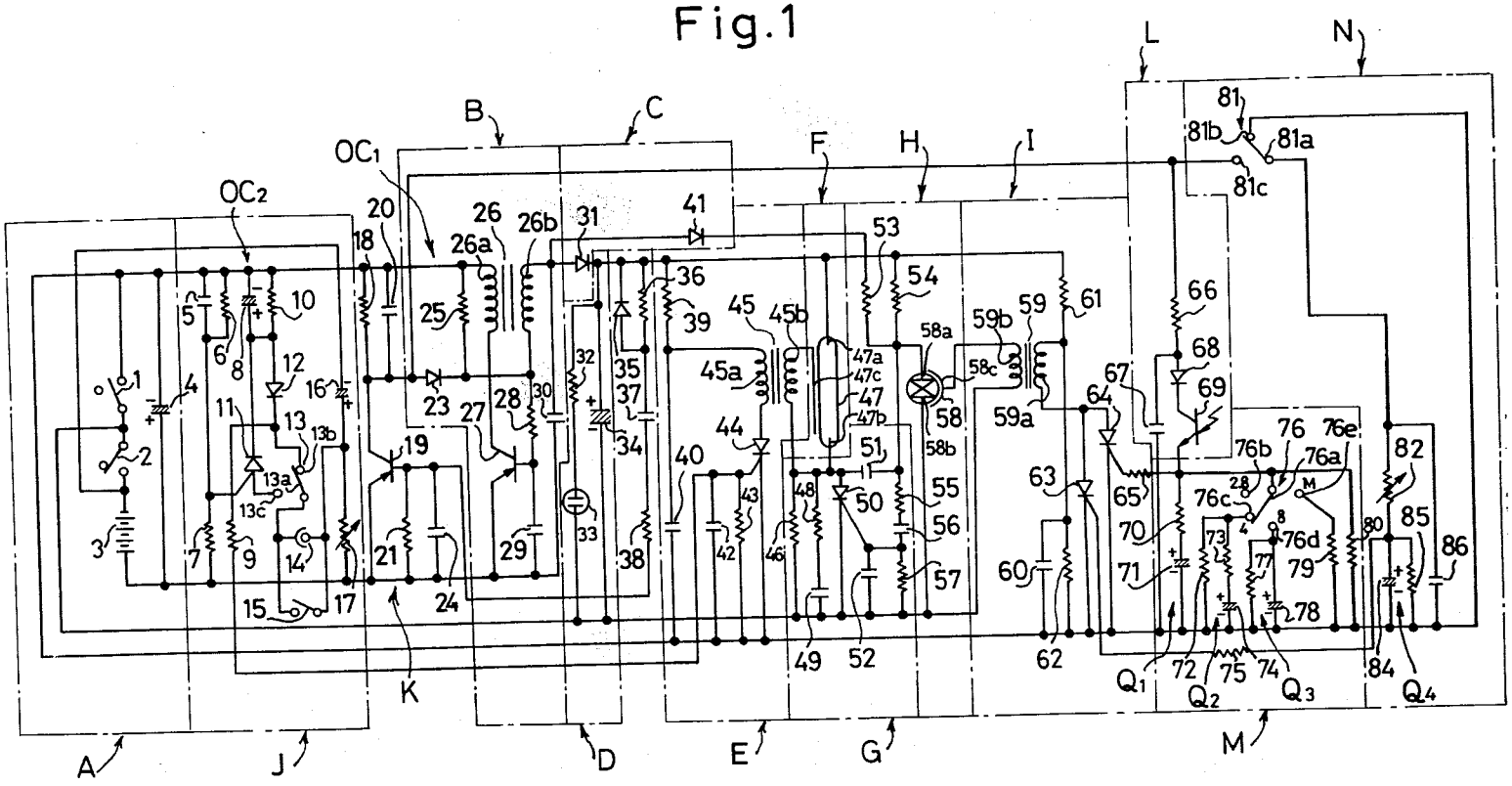
FIG. 1 shows a detail circuit diagram of an electric flash apparatus in accordance with the invention.

Referring to FIG. 1 of the drawing, there is shown an electric flash apparatus comprising power supplying means including a direct current power source circuit A having a battery 3, voltage converting means for converting a direct current voltage from the direct current power source circuit A to a high voltage alternating voltage and for rectifying the alternating current voltage to a direct current voltage, electric energy storing means for storing electric energy and including an electric charge storing circuit C having a main storage capacitor 34, flashlight generating means including a flash tube circuit F having a flash tube 47, trigger signal generating means including a trigger signal generating circuit E for triggering the flash tube 47 of the flash tube circuit E, a switching circuit G for switching flash current of the flash tube 47, a quenching circuit H for controlling the switching circuit G, and quench trigger signal generating circuit I for controlling the quenching circuit H.

The voltage converting means comprises a voltage converter circuit B for converting the direct current voltage from the direct current power source circuit A to the high alternating current voltage, and a rectifier circuit C for rectifying the alternating current voltage from the voltage converter circuit B.

The electric flash apparatus of the present invention further comprising trigger signal controlling means having a trigger signal controlling circuit J for controlling a triggering operation of the trigger signal generating circuit E, an oscillation controlling circuit K for controlling the operation of the voltage converter circuit B, a light receiving circuit L for sensing a flashlight which is produced from the flash tube 47 of the flash tube circuit F and is reflected from an object to be photographed (not shown in the drawing), and flash stop timing controlling means.

As is shown in FIG. 1, the direct current power source circuit A comprises a battery 3, power source switches 1 and 2 which are made ON and OFF together with other, and a capacitor 4 connected in parallel to the battery 3 by way of the switches 1 and 2. The voltage converter circuit B has, substantially, a first oscillator circuit $OC_1$ and is connected to the battery 3 by way of the power source switches 1 and 2. The rectifier circuit C is connected to an output side of the voltage converter circuit B. The electric charge storing circuit D is connected to the voltage converter circuit B by way of the rectifier circuit C.

The trigger signal generating circuit E activates when a synchronous switch 14 or a test button switch 15 is made in its ON state. The flash tube circuit F has the flash tube 47 and is connected to the electric charge storing circuit D. The switching circuit G is connected to the flash tube circuit F. The quenching circuit H is connected in parallel to the flash tube circuit F by way of the switching circuit G. The quench trigger signal generating circuit I is connected in parallel to the quenching circuit H.

The trigger signal controlling circuit J is provided between the direct current power source circuit A and the trigger signal generating circuit E. The oscillation controlling circuit K is provided between the voltage converter circuit B and the flash tube circuit F. The light receiving circuit L is connected between the voltage converter circuit B and the quench trigger signal generating circuit I.

The flash stop timing control means comprises a first light exposure controlling circuit M and a second light exposure controlling circuit N. The first light exposure controlling circuit M is connected between the light receiving circuit L and the quench trigger signal generating circuit I. The second light exposure controlling circuit N is connected between the voltage converter circuit B and the quench trigger signal generating circuit I.

In more detail, the voltage converter circuit B comprises, substantially, a first oscillator $OC_1$. Namely, the voltage converter circuit B includes a switching element in the form of a transistor 27 of which an emitter electrode is connnected to a positive terminal of the battery 3, an oscillating transformer 26 having a primary coil 26*a* connected to the battery 3 by way of a collector-emitter path of the transistor 27 and the power source switches 1 and 2, a resistor 28 connected between a negative terminal and a base electrode of the transistor 26, an oscillating capacitor 29 connected between the emitter electrode and the base electrode of the transistor 27, and a capacitor 30 connected to a secondary side of the oscillating transformer 26. The capacitor 30 absorbs the surge voltage induced at the secondary coil 26*a* of the oscillating transformer 26. One terminal of the secondary coil 26*b* is connected to the base electrode of the transistor 27 by way of the resistor 28. The rectifier circuit C comprises a first diode 31 and a second diode 41 which are connected to other terminal of the secondary coil 26*b* of the transformer 26.

The electric charge storing circuit D has a main storage capacitor 34 which is connected to the first diode 31 of the rectifier circuit C and the positive terminal of the battery 3, and an indicating lamp in the form of a neon glow lamp 33 connected in parallel to the main storage capacitor 34 by way of a protecting resistor 32. The trigger signal generating circuit E comprises a protecting resistor 39, a triggering capacitor 40 which is connected in parallel to the main storage capacitor 34 by way of the protecting resistor 39, a first triggering transformer 45 having a primary coil 45*a* and a secondary coil 45*b*, a first thyristor 44 connected in parallel to the triggering capacitor 46 by way of the primary coil 45*a* of the triggering transformer 45, a gate capacitor 42 and a gate resistor 43 which are connected between a gate electrode and a cathode electrode of the thyristor 44.

The flash tube circuit F includes a flash tube 47 of which a main current conducting electrode 47*a* is connected to the diode 31 of the rectifier circuit C and a triggering electrode 47*c* is connected to the secondary coil 45*b* of the triggering transformer 45.

The switching circuit G comprises a second switching element in the form a second thyristor 50, a commutation capacitor 51, a commutation resistor 46, capacitors 49, 52 and 56, and resistors 48, 55 and 57 and is connected as shown. The quenching circuit H includes protecting resistors 53 and 54 and quench tube 58 having a pair of main current conducting electrodes 58*a* and 58*b* and a trigger electrode 58*c*. The quench tube 58 is also connected to both main current conducting electrodes 47*a* and 47*b* of the flash tube 47 and the main storage capacitor 34 of the electric charge storing circuit D.

The quench triggering circuit I includes protecting resistors 61 and 62, a second triggering capacitor 60 and a second triggering transformer 59. The trigger capacitor 60 is connected between the first diode 31 of the rectifier circuit C and the positive terminal of the battery 3 of the direct current power source circuit A. A primary coil 59*a* of the second triggering transformer 59 is connected to trigger capacitor 60 by way of a third switching element in the form of a third thyristor 63 and a fourth thyristor 64.

The trigger signal controlling circuit J comprises a second oscillator circuit $OC_2$, a changeover switch 13 having stationary contacts 13*b* and 13*c* and a movable contact 13*a*, a synchronous switch 14 and a test button switch 15. The second oscillator circuit $OC_2$ comprises a programmable unijunction transistor (hereinafter called PUT). An anode electrode of the PUT 11 is connected to the stationary contact 13*c*.

The stationary contact 13*b* of the changeover switch 13 is connected to the capacitor 16 and the resistor 10 by way of the diode 12. The movable contact 13*a* of the changeover switch 13 is connected to a juncture of the variable resistor 17 and the capacitor 16 by way of the switches 14 and 15. A juncture of a cathode electrode of the diode 12 and the stationary contact 13*b* of the changeover switch 13 is connected to the gate electrode of the first thyristor 44 of the trigger signal generating circuit E by way of a resistor 9.

The oscillation controlling circuit K comprises a transistor 19 of which a collector electrode is connected to the battery 3 of the direct current power source circuit A by way of a protecting resistor 18 and the power source switch 1, a diode 23 connected between the collector electrode of the transistor 19 and the secondary coil 26*b* of the oscillating transformer 26 of the voltage converter circuit B, a noise protecting resistor 21 and a noise protecting capacitor 24 which are connected between an emitter electrode and a base electrode of the transistor 19, a control capacitor 37 connected between the base electrode of the transistor 19 and the main storage capacitor 34 of the electric charge storing circuit D by way of the resistors 36 and 38 and a diode 35 connected in parallel to the resistor 36.

The light receiving circuit L comprises a protecting resistor 66, a diode 68, a light sensing element in the form of a phototransistor 69 and a capacitor 67. The phototransistor 69 is connected to a juncture of the collector electrode of the transistor 19 and an anode electrode of the diode 23 of the oscillation controlling circuit K.

The first light exposure adjusting circuit M comprises a first integration circuit $Q_1$ having a resistor 70 and an integration capacitor 71 connected to the phototransistor 69 of the light receiving circuit L and the gate electrode of the fourth thyristor 64 of the quench trigger signal generating circuit I, a second integration circuit $Q_2$ comprising series connected a resistor 73 and an integration capacitor 74 and a resistor 72 connected to a series circuit of the resistor 73 and the integration capacitor 74, a third integration circuit $Q_3$ having parallel connected a resistor 77 and an integration capacitor 78, and a changeover switch 76 having a movable contact 76*a* and stationary contacts 76*b*, 76*c*, 76*d* and 76*e*. The movable contact 76*a* is connected to the gate electrode of the fourth thyristor 64 of the quenching trigger signal generating circuit I. The stationary contact 76*c* of the changeover switch 76 is connected to the second integration circuit $Q_2$, and the stationary contact 76*d* is connected to the third integration capacitor $Q_3$.

The second light exposure adjusting circuit N comprises a fourth integration circuit $Q_4$ and a light exposure selecting switch in the form of a changeover switch 81. The fourth integration circuit $Q_4$ comprises a variable resistor 82, an integration capacitor 84 connected to the variable resistor 82 in series relationship, a resistor 85 and a capacitor 86, and is connected as shown. The changeover switch 81 has a movable contact 81*a* connected to the fourth integration circuit $Q_4$, and a first stationary contact 81*b* connected to the circuit $Q_4$ and a second stationary contact 81*c* connected to the phototransistor 69 of the light receiving circuit L and a juncture of the collector electrode of the control transistor 19 and the diode 23 of the oscillation controlling circuit K.

In operation, when the power source switches 1 and 2 are made in its ON state, current is supplied to the oscillating capacitor 29 from the battery 3 of the power source circuit A through a loop formed by the oscillating capacitor 29. When a charging voltage is attained to a predetermined value, the transistor 27 is made conductive. By the conduction of the transistor 27, a current flows through the primary coil 26*a* of the oscillating transformer 26 from the battery 3 by way of the emitter-collector path of the transistor 27 to perform the oscillating operation, and thereby the voltage converter circuit B commences oscillating operation and produces high alternating current voltage from the secondary coil 26*b*. In this case, the oscillating voltage due to the stray capacity of the windings of the transformer 26 or the oscillating capacitor 29 is also employed to cause the ON and OFF switching of the oscillating transistor 27. The high alternating current voltage is rectified by the diodes 31 and 41 of the rectifier circuit C, to produce a high direct current voltage. The oscillating operation of the oscillator circuit $OC_1$ continues because of the electric-magnetic connection in the transformer 26 by which the energy stored in the inductance of the transformer 26 produces the current required to flow into the base electrode of the transistor 27 to sustain the oscillation. The surge absorbing capacitor 30 reduces the reverse voltage generated at the secondary coil 26*b* and compensates a signal by absorbing the surge voltage.

The alternating current voltage induced at the secondary coil 26*b* is rectified by the diodes 31 and 41, and thereby the current flows to the main storage capacitor 34, the trigger capacitors 40 and 60. By this current, the electric charge is stored on the main capacitor 34 of the electric charge storing circuit D, at a polarity as shown in FIG. 1 and, at the same time, the electric charge is also accumulated on the oscillation controlling capacitor 37 of the oscillation controlling circuit K and the triggering capacitors 40 and 60.

When the main storage capacitor 34 is fully charged up to the predetermined voltage, the neon glow lamp 33 lights indicating that the device is ready for the flash tube 47 to be fired. When the movable contact 13*a* of the changeover switch 13 of the trigger controlling circuit is contacted with the first stationary contact 13*b*, the flash tube 47 may then be fired by closing the camera shutter switch 14. By closing the switch 14 the electric charge stored on the capacitor 16 discharges through the first stationary contact 13*b*, the movable contact 13*a* of the changeover switch 13, the resistor 9 and the gate electrode of the thyristor 44 of the trigger signal generating circuit E. By discharge of the capacitor 16, the thyristor 44 is triggered to be conductive. When the thyristor 44 is made conductive, the electric charge stored on the first triggering capacitor 40 discharges through the primary coil 45*a* of the first triggering transformer 45, and the thyristor 44. The high voltage pulse is induced in the secondary coil 45*b* of the transformer 45 appears at the trigger electrode 47*c* of the flash tube 47 and ionizes a portion of the gas in the flash tube 47. The main storage capacitor 34 then discharges through the gas between the main current conducting electrodes 47*a* and 47*b*, producing a brilliant flash of illumination. It will be readily appreciated that the flashing of the flash tube 47 is performed only one time, because the movable contact 13*a* is connected to the first stationary contact 13*b* in the trigger controlling circuit J.

The phototransistor 69 of the light receiving circuit L senses the reflecting light of the flash light produced by the flash tube 47 and becomes conductive in response to the quantity of the reflecting light. By the conduction of the phototransistor 69, electric charge is stored on the integration capacitor 71 of the first integration circuit $Q_1$ and any one of the integration capacitors 74 and 78 of the circuits $Q_2$ and $Q_3$, and thereby the charging of the integration capacitor 71 and any one of the capacitors 74 and 78 increase to predetermined value which are corresponded to quantity of the flash light. When these integration capacitors 71 and 74 or 78 attain to predetermined value, the gate electrode of the thyristor 64 is triggered to make the thyristor 64 conductive. When the thyristor 64 becomes conductive, electric charge stored on the second triggering capacitor 60 discharges through the primary coil 59*a* of the second triggering transformer 59 and the thyristor 64, and thereby high voltage pulse generates at the secondary coil 59*b* to trigger the quenching tube 58. When the quenching tube 58 is triggered, the discharging current to be supplied to the flash tube 47 is by-passed through the quenching tube 58 and, at the same time, the electric charge stored on the commutation capacitor 51 discharges through the quenching tube 58 and the commutation resistor 46 and the second thyristor 50 is reversely biassed to become non-conductive. When the second thyristor is turned OFF, the flashing operation of the flash tube 47 is stopped.

There are, of course, certain criteria that must be met in quench tube 58. To operate effectively, the quench tube 58 must have a low impedance compared with the flash tube 47. To provide such low impedance, the quench tube 58 also should have a low gas pressure and a small electrode spacing. The electrodes 58*a* and 58*b* must be capable of carrying a very high current for short time. The quench tube 58 must be capable of being triggered rapidly and easily into conduction over the range of voltage change across the flash tube during the flash. The quench tube 58 includes the trigger electrode 58*c* spaced midway between the two main electrodes 58*a* and 58*b*.

By the trigger signal supplied from the triggering transformer 59, the quench tube 58 is activated to be conductive. When the quench tube 58 becomes conductive, the charging current from the main storage capacitor 34 of the electric charge storing circuit D is bypassed by the quench tube 58 to stop the flash operation of the flash tube 47 of the flash tube circuit F, because the internal resistance of the quench tube 58 is smaller than that of the flash tube 47.

In more detail, after the main storage capacitor 34 has been discharged, a terminal voltage of the main storage capacitor 34 of the electric energy storing circuit D becomes low and thereby the electric charge stored on the control capacitor 37 is automatically discharged by way of the protecting resistor 36, the diode 35, the flash tube 47 and base-emitter path of the control transistor 19. By discharging of the control capacitor 37, a positive potential appears at the base circuitry of the control transistor 19 and the transistor 19 becomes conductive. By the conduction of the control transistor 19, a primary side of the voltage converter circuit B is shortcircuited and thereby the oscillating operation of the voltage converter circuit B is stopped. When the transistor 19 becomes conductive, the electric energy of the battery 3 is supplied to the phototransistor 69 by way of the transistor 19, the resistor 66 and the diode 68. Under these conditions, the phototransistor 69 senses the reflecting light reflected from the object to be photographed of the flashlight produced from the flash tube 47.

In this case, the light quantity controlling operation is performed by the first light exposure adjusting circuit M since the light exposure control selecting switch 81 of the second light exposure adjusting circuit N is set so that the movable contact 81*a* is connected to the first stationary contact 81*b*, when the movable contact 13*a* of the flash selecting switch 13 is connected to the first stationary contact 13*b* in the trigger signal controlling circuit J. In the first light exposure adjusting circuit M, the first integration circuit $Q_1$ corresponds to a diaphragm value F=2.8, the second integration circuit $Q_2$ corresponds to a diaphragm value F=4 and the third integration circuit $Q_3$ corresponds to a diaphragm value F=8. Accordingly, the light exposure can be selected by means of changeovering the light exposure selecting switch 76.

When the movable contact 13*a* is connected to the second stationary contact 13*c* of the changeover switch 13 in the trigger signal controlling circuit J, the changeover switch 81 is also changeovered such that the movable contact 81*a* is connected to the second stationary contact 81*c*. Under these conditions, the second oscillator circuit $OC_2$ of the trigger controlling circuit J performs the oscillating operation in order to supply the gate signal to the first thyristor 44 when the synchronous switch 14 or the test button switch 15 is closed. Namely, when the synchronous switch 14 is made ON, the PUT 11 repeats the On and OFF operations according to the time constant value of the capacitance value and the resistance value. In accordance with the ON and OFF operations of the PUT 11, voltage pulse signals as the gating signals are supplied to the gate electrode of the thyristor 44 of the trigger signal generating circuit E from the capacitor 16 by way of the diode 12 and the resistor 9. By the gating signals supplied from the trigger signal controlling circuit J, the first thyristor 44 repeats the ON and OFF operations and thereby the discharging of the triggering capacitor 40 is also repeated to trigger the trigger electrode 47*c* of the flash tube 47. Accordingly the multi-flashing of the flash tube 47 is performed. In this case, when the flash tube 47 carried out the full flash, all of the electric charge stored on the main storage capacitor 34 of the electric charge storing circuit D discharges and thereby the multi-flashing operation can not be performed. In accordance with flash apparatus, the flash stopping time of the flash tube 47 of the flash tube circuit F is set so as to be short by means of time constants of the integration circuits.

When the electric charge is stored on the capacitor 16 of the second oscillator circuit $OC_2$ of the trigger signal controlling circuit J and the charging voltage of the capacitor 16 attains to a predetermined value, the PUT 11 becomes conductive. The PUT 11 repeats ON and OFF operations and the second oscillator circuit $OC_2$ performs the oscillating operation. The ON and OFF time durations can be changed by setting the resistance value of the variable resistor 17. The multi-flashing of the flash tube 47 is carried out by pulse signals supplied from the trigger signal controlling circuit J.

Next, the flashlight quantity controlling operations will be described. When the switch 13 is set such that the movable contact 13*a* is connected to the stationary contact 13*c*, the switch 81 is also set such that the movable contact 81*a* is connected to the stationary contact 81*c*. In such conditions, when the control transistor 19 becomes conductive due to the flashing of the flash tube 47, the voltage of the battery 3 is applied to the second light exposure adjusting circuit N through the emitter-collector path of the control transistor 19. In the circuit N, the electric charge is stored on the integration capacitor 84 of the fourth integration circuit $Q_4$ through the variable resistor 82. When a predetermined time interval, has elapsed, the third thyristor 63 is made conductive to operate the quench signal generating circuit I. The ON time duration of the third thyristor 63 is set so as to be shorter than the full flashing time duration of the flash tube 47, by means of the fourth integration circuit $Q_4$ consisting of the variable resistor 82 and the integration capacitor 84. The conduction timing of the thyristor 63 can be changed by changing the resistance value of the variable resistor 82 of the second light exposure controlling circuit N. When the thyristor 63 turns ON, the trigger pulse generates at the triggering transformer 59, and the quench tube 58 is made conductive and the flashing of the flash tube 47 is stopped. The repetition of the flashing of the flash tube 47 is carried out during a predetermined time interval such as 1 second. In this case, the resistance value of the variable resistor 82 may be set such that the guide number is ninth.

When the changeover switch 76 is set so that the movable contact **76*a* is connected to the stationary contact 76*m*, the gate circuitry of the thyristor 64 is shortcircuited and the thyristor 64 does not operate. Therefore, the thyristor 63 can operate only, and the light exposuring is peformed by the thyristor 63**.

The stationary contact **76*b* of the changeover switch 76 corresponds to F=2.8, the stationary contact 76*b* corresponds to F=4, and the stationary contact 76*d* corresponds to F=8. When the movable contact 76*a* is connected to the stationary contact 76*c*, the F-number is set to F 4, and the electric charge is stored on the integration capacitors 71, 74 and 84 to make the thyristor 63 or 64 conductive. When the movable contact 76*a* is connected to the stationary contact 76*d*, the F-number is set to F 8 and the electric charge is stored on the capacitors 71, 78 and 84 to make the thyristors 63 and 64** conductive.

When the distance between the flash device and an object to be photographed is short in photographing, the integrating operation of the first light exposure adjusting circuit M is made faster than that of the second light exposure adjusting circuit N, because the reflecting light quantity is much more than that in long distance photographing. To contrary, the integrating operation of the first integration circuit $Q_1$ of the first light exposure adjusting circuit M is set so as to be later than that of the fourth integration circuit $Q_4$ of the second light exposure adjusting circuit N.

Figure 2A:
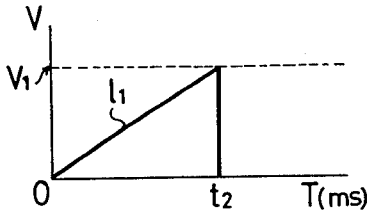
FIGS. 2A to 2C show characteristics of an electric flash apparatus of the present invention when the distance from the apparatus to an object to be photographed is short.
Figure 3A:
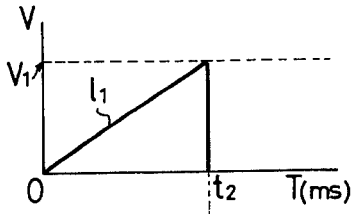
FIGS. 3A to 3C show characteristics of an electric flash apparatus of the present invention when the distance is far from the apparatus to an object to be photographed.
Figure 2B:
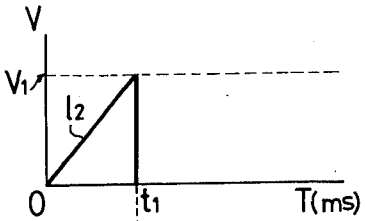
Figure 3B:
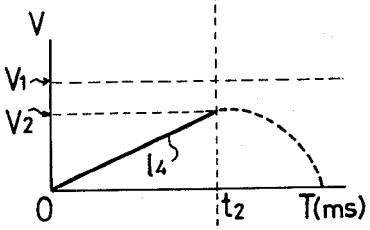
Figure 2C:
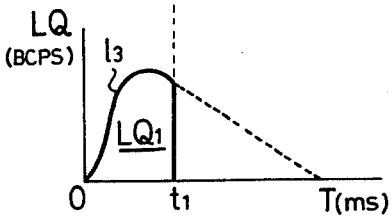
Figure 3C:
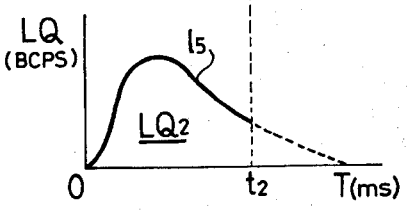

FIGS. 2A to 2C show characteristics of the flash apparatus of FIG. 1 when the distance between the flash device and the object to be photographed is short. FIGS. 3A to 3C show characteristics of the flash device when the distance between the flash device and the object to be photographed is long. As is shown by a curve $l_1$ of FIG. 2A, the charging voltage of the integration capacitor 84 is set an operating voltage of the thyristor 84 $V_2$ at a time point $t_2$. When the photographing distance is short, the resultant integrating voltage of the integration circuit $Q_1$ and $Q_2$ attains to an operating voltage of the thyristor 64 at a time point $t_2$, in case that the movable contact **76*a* of the changeover switch 76 is connected to the stationary contact 76*c* at a time point $t_1$ which is smaller than the time $t_2$, because the quantity of the reflecting light which is produced and is reflected from the object to be photographed is intensity as is shown by a curve $l_2$ of FIG. 2B. Accordingly, the thyristor 64 is firstly made conductive, and the quench tube 58 is triggered to stop the flashing of the flash tube 47 at a time point $t_1$, as is shown by a curve $l_3$ of FIG. 2C. In this case, the quantity of the flashlight of the flash tube 47** is $LQ_1$.

When the distance between the flash apparatus and the photographing object is long, the charging voltage of the integration capacitor 84 attains to the operating voltage $V_1$ of the thyristor 63 at time $t_2$, and the resultant charging voltage of the integration capacitors 71 and 74 attains to the voltage $V_2$ which is lower than the voltage $V_1$ at the time point $t_2$, as is shown by a curve $l_4$ of FIG. 2B. Accordingly, the thyristor 63 is made conductive by the charging voltages $V_1$ of the integration capacitor 84 of the second light adjusting circuit N at the time point $t_2$, and thereby the quench tube 58 is triggered to stop the flashing of the flash tube 47 of the flash tube circuit F. In this case, the light quantity of the flashlight is $LQ_2$ which is larger than the light quantity $LQ_1$. In the second light exposure adjusting circuit, the integration timing of the fourth integration circuit $Q_4$ can be adjusted by means of setting the resistance value of the variable resistor 82. Further, the second light exposure adjusting circuit N acts as an automatic light adjusting device.

In thus manner, the signal is firstly applied to the thyristor 64 particularly when the distance from the flash device to the object to be photographed is close, and thereby the flashing of the flash tube 47 is stopped at time point $t_1$ which is smaller than the time point $t_2$ when the charging voltage of the fourth integration circuit $Q_4$ attains to the actuating voltage of the thyristor 63. Accordingly, the quantity of the flashlight of the flash tube 47 is controlled so as to be fewer than that in long distance photographing. To contrary, the quantity of the flashlight of the flash tube 47 is controlled so as to be suitable value when the photographing distance is relatively long, and therefore suitable light exposure can be obtained, because the signal is applied to only the thyristor 63 in long distance photographing.

In accordance with the electric flash apparatus, both of the mono-flashing operation and the multi-flashing operation can be carried out, since the flashing mode changeovering means is employed in the flash apparatus. Further, the light quantity control can be effectively performed in both of the long and short distance photographings, since the light exposure control changeovering means is used in the flash apparatus.

According to the present invention, a good performance and convenient flash apparatus can be obtained, since the quantity of the flashlight can be adjusted in accordance with the photographing distance as well as the flashing times and the repetition can be adjusted.

In view of the above, it will be seen that the several object of the invention are achieved and other advantageous results are attained.

While a preferred embodiment of the invention has been shown and described, it will be apparent to those skilled in the art that modifications can be made without departing from the object and the spirit of the invention, the scope of which is defined in the appended claims. Accordingly, the foregoing embodiment is to be considered illustrative, rather than restricting of the meaning and the range of equivalency of the claims are to be included herein.

What is claimed is:

1. In an electric flash apparatus comprising electric power source means including a direct current power source circuit, converting means including an oscillator circuit for boosting the voltage of said direct current power source circuit and for generating a direct current voltage, electric energy storing means including a main storage capacitor for storing electric energy from said converting means, flashlight generating means including a flash tube for generating flashlight, trigger signal generating means for generating a triggering signal for triggering the flash tube, triggering signal controlling means for actuating said trigger signal generating means, and flash light quantity control means for adjusting automatically the light quantity of the flashlight of said flashlight generating means when a reflecting light of the flashlight produced by the flash tube and reflected from an object to be photographed attains to a predetermined value, the improvement comprising:

a synchronous switch having on and off states, a trigger signal control circuit which operates in a first mode for applying a mono-pulse to said trigger signal generating means during the on state of the synchronous switch and in a second mode for applying a multipulse to said trigger signal generating means during the on state of the synchronous switch, and change-over switch means for effecting operation of said trigger signal control circuit in said first or second mode.

2. An electric flash apparatus as claimed in claim 1, wherein said flashlight quantity generating means includes a flashlight quantity selecting means for selecting a flash stop timing of said flash tube.

3. An electric flash apparatus as claimed in claim 1, said converting means comprises a converter circuit for converting the direct current voltage from said direct current power source circuit to an alternating current voltage, and a rectifier circuit for rectifying the alternating current voltage from said voltage converter circuit.

4. An electric flash apparatus as claimed in claim 3, wherein said converting means further comprises an oscillation controlling circuit for stopping the oscillating operation of the converter circuit when the flash tube of the flash tube circuit flashes.

5. An electric flash apparatus as claimed in claim 3, wherein said converter circuit comprises a first oscillator including an oscillating transformer and a switching element for switching current flowing in said oscillating transformer.

6. An electric flash apparatus as claimed in claim 1, wherein said trigger signal control circuit comprises multi-pulse signal generating means for generating multi-pulse signals, flash mode selecting means for changing over the mono-flash or multi-flash of said flash tube, and a synchronous contact operated in synchronism with a camera shutter.

7. An electric flash apparatus as claimed in claim 1, wherein said flashlight quantity control means comprises a flash stopping circuit for stopping the flashing of said flash tube circuit, a flash stopping signal generating circuit for actuating said flash stopping circuit, a light receiving circuit for sensing and converting a reflecting light of the flashlight produced by the flash tube and reflected from an object to be photographed to an electrical energy, and flash stop timing control means for actuating said flash stopping signal generating circuit according to said electrical energy of the light receiving circuit.

8. An electric flash apparatus as claimed in claim 7, wherein said flash stop timing control means comprises a first light exposure adjusting circuit for controlling the flash stop timing of said flash tube and a second light exposure adjusting circuit of the flash stop timing of said flash tube.

9. An electric flash apparatus as claimed in claim 8, wherein said first light exposure adjusting circuit includes a first integration circuit for integrating the electrical energy from said light receiving circuit and for controlling the flash stopping signal generating circuit.

10. An electric flash apparatus as claimed in claim 9, wherein said first light exposure adjusting circuit further includes a second integration circuit for integrating the electrical energy from the light receiving circuit, a third integration circuit for integrating the electrical energy from said light receiving circuit and a light exposure changeovering switch for changeovering said first integration circuit and said third integration circuit.

11. An electric flash apparatus as claimed in claim 8, wherein said second light exposure adjusting circuit comprises a fourth integration circuit for integrating electrical energy from a battery of power direct current source circuit when the main storage capacitor of the electrical energy storing means has discharged the electric charge and for controlling the flash stopping signal generating circuit.

12. An electric flash apparatus as claimed in claim 11, said second light adjusting circuit further comprises a light adjusting selection switch for selecting the stop timing of said flash tube.

13. An electric flash apparatus as claimed in claim 7, wherein said flashlight quantity controlling means further comprises a switching circuit for switching flash current of the flash tube of said flash tube circuit.

14. An electric flash apparatus as claimed in claim 7, wherein said flash stopping signal generating circuit comprises a second triggering transformer, a second trigger capacitor, and a third and fourth thyristors for switching current flowing in said discharge current from said second trigger capacitor.

15. An electric flash apparatus as claimed in claim 7, wherein said light receiving circuit includes a phototransistor for converting flashlight quantity to an electrical energy.

16. An electric flash apparatus as claimed in claim 1, wherein said trigger signal controlling circuit comprises a second oscillator circuit for generating multi-pulse signal, and a synchronous contact operated by a camera shutter.

* * * * *